United States Patent [19]

Jensen

[11] B 3,998,511

[45] Dec. 21, 1976

[54] FULL-CIRCLE CONTACT ELECTRICAL SLIP-RING BRUSH

[75] Inventor: Harry T. Jensen, Milford, Conn.

[73] Assignee: United Technologies Corporation, Hartford, Conn.

[22] Filed: Apr. 9, 1975

[21] Appl. No.: 566,556

[44] Published under the second Trial Voluntary Protest Program on March 23, 1976 as document No. B 566,556.

[52] U.S. Cl. ..... 339/5 M; 339/8 R; 339/252 R; 339/278 M

[51] Int. Cl.[2] ..... H01R 39/00

[58] Field of Search ..... 339/5 R, 5 M, 5 S, 6 R, 339/6 A, 8 R, 8 A, 252 R, 252 S, 278 M

[56] References Cited

UNITED STATES PATENTS

| | | | |
|---|---|---|---|
| 2,414,543 | 1/1947 | Moberly | 339/5 S |
| 3,489,982 | 1/1970 | Dauphinee | 339/5 R |
| 3,724,067 | 4/1973 | Tygard | 339/5 M |

*Primary Examiner*—Roy Lake
*Assistant Examiner*—DeWalden W. Jones
*Attorney, Agent, o r Firm*—M. P. Williams

[57] ABSTRACT

An electrical slip-ring brush which provides full-circle electrical contact with a rotating member comprises a main, annular housing of electrically conductive material having a plurality of circular-segment carbon brush elements loose-pinned therein, contact between the housing and the brush segments being assured by an annular leaf-spring assembly, the brush segments being resiliently urged radially inwardly by annular springs disposed on the outer periphery thereof. An electrical contact is made to the housing.

2 Claims, 4 Drawing Figures

FULL-CIRCLE CONTACT ELECTRICAL SLIP-RING BRUSH

BACKGROUND OF THE INVENTION

1. Field of Invention

This invention relates to rotary electrical contacts, and more particularly to a full-circle contact, electrical slip-ring brush assembly.

2. Description of the Prior Art

The use of slip-rings in conjunction with carbon brushes resiliently urged thereagainst as a means of forming rotary electrical contact is well known. In the application of power (such as in alternators, generators and motors), suitable operation has been achieved over relatively long lifetimes. However, in the case of rotary electrical connections used for the passage of small signals, such as the outputs of sensing transducers and the like, the discrete carbon brush has historically proved less than satisfactory, giving rise in some cases to excessive noise signals and in other cases to lack of assurance of a sufficiently solid ohmic contact so as to avoid the loss of discrete signals. Further, it has traditionally been difficult to transmit large currents in small-diameter applications, due to the minimal achievable brush density.

SUMMARY OF INVENTION

An object of the present invention is to provide improved rotary electrical connections.

According to the present invention, rotary electrical connection is made by annular carbon brush contacting means, whereby electrical contact with a rotating body of circular cross section is maintained against the entire peripheral surface of the rotating body. According to the invention in one form, rotary electrical connection is made by a plurality of carbon brush elements, each consisting of a circular sector, the brush elements being loose-pinned in a housing to which they are maintained in contact by means of an annular leaf spring means, the brush sectors being resiliently urged radially inwardly by annular spring means in contact with the outer periphery thereof.

The invention may be practiced using elements and components known to the art. The invention provides contact with the entire surface of a rotating element of circular cross section, thereby to avoid noisy operation which can result from discontinuities, such as may be caused by flaws and the like. The invention is useful in handling high currents, even in small-diameter applications, due to its large electrical contact area.

The foregoing and other objects, features and advantages of the present invention will become more apparent in light of the following detailed description of a preferred embodiment thereof, as illustrated in the accompanying drawing.

DESCRIPTION OF THE PREFERRED EMBODIMENT

Figure 1:
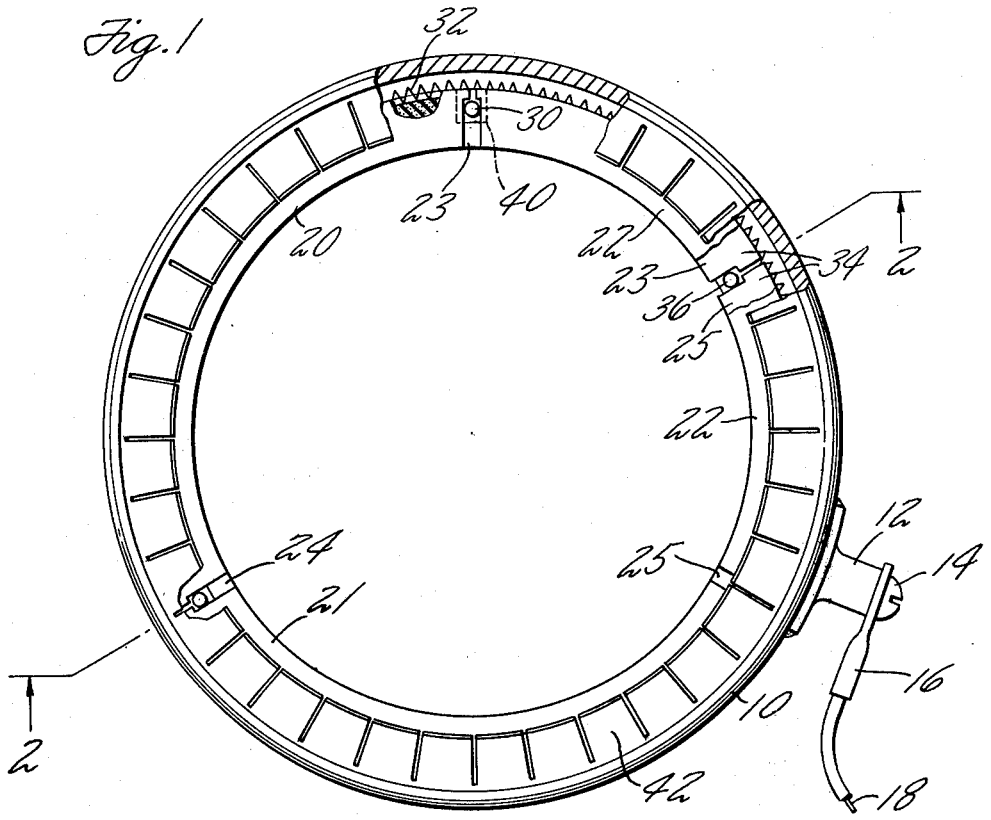
FIG. 1 is a partially broken away plan view of an exemplary embodiment of the present invention.
Figure 2:
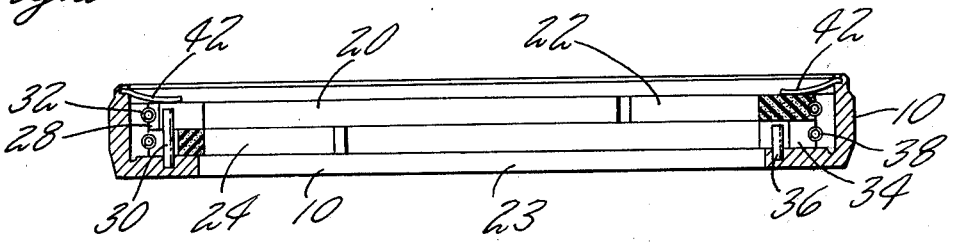
FIG. 2 is a section, taken on the line 2—2 in FIG. 1, of the exemplary embodiment of the invention.

Referring now to FIGS. 1 and 2, a typical embodiment of a full-circle contact electrical slip ring brush consists of an annular frame member 10 having a generally L-shaped cross section, and comprised of a suitable electrically-conductive material, such as metal. As is known, if extremely high electrical conductivity is required, the metal may appropriately be selected from copper or noble metals; on the other hand, if a corrosive or mechanically hostile environment is involved, the metal may be a suitable steel. Since conduction is provided throughout the entire periphery of the device, the nature of the metal is less important than it might be in a singlecontact brush element known to the art. As shown in FIG. 1, an electrical contact 12 may be disposed in good electrically conductive fashion to the frame 10 such as by soldering or brazing or the like, in any well known fashion. The contact 12 may be tapped so as to receive a screw 14 in order to bind an electrical contacting lug 16 to the contact 12, thereby to provide good electrical contact between an electrical conductor 18 and the frame 10.

Figure 3:
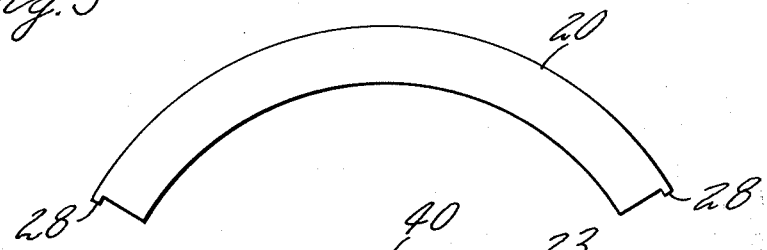
FIG. 3 is a plan view of an upper brush of the embodiment of FIG. 1.
Figure 4:
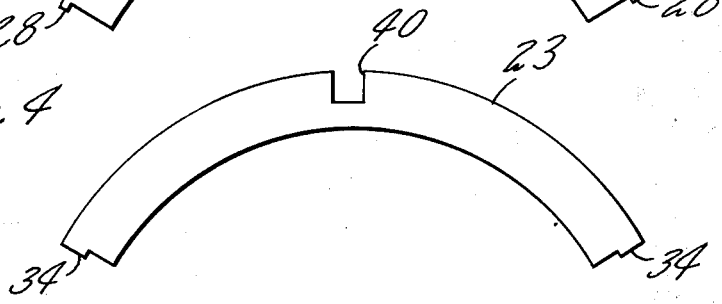
FIG. 4 is a plan view of a lower brush of the embodiment of FIG. 1.

To provide electrical contact with a rotating member within the slip-ring brush, there are provided a plurality of brush elements composed of a suitable, self-lubricating, electrically conductive material, such as graphited carbon. In the present embodiment, the brush elements are circular segments, there being three upper brush elements 20–22 and three lower brush elements 23–25. The shape of the brush elements is illustrated by the upper brush element 20, shown in FIG. 3, and the lower brush element 23, shown in FIG. 4. At each end of each of the upper brush elements 20–22, there is provided a short lip 28 adapted to engage a pin 30 so as to retain the brush elements in place within the frame 10, against the radially-inward force applied by a suitable resilient means such as an annular spring 32. Each of the lower brush elements 23–25 is similarly provided at each end with a somewhat longer lip 34 adapted to engage a related pin 36 to loosely retain it within the frame 10 against the radially inward urging of an annular spring 38. The lower brush elements 23–25 are also provided with a notch 40 to permit passage of the pins 30 therethrough. The springs 32, 38 are lodged in annular notches (unnumbered) which traverse the entire outer periphery of the brush elements 20-25. In order to cause good contact between the frame 10 and the brush elements 20–25, there is provided an annular, segmented leaf spring 42 which is secured within an annular notch (unnumbered) in the frame 10, as is illustrated more clearly in FIG. 2 (the bulk of the spring 42 has been eliminated in FIG. 2 for clarity). Retention of the spring 42 within the frame 10 (FIG. 2) may be achieved by providing the frame 10 initially with an upwardly extended annular lip which can be crimped down over the spring after the spring is in place, or in any other suitable fashion.

With the exception of the electrical components 12–18, a structure generally as described herein has found use as a seal for rotary shafts.

Good electrical contact is provided since, even at the junction of each of the upper brush elements 20–22 with one another, electrical contact is continuously made by a related one of the lower brush elements 23–25. Being in continuous contact with the rotating member which it surrounds, the slip ring brush of the present invention is less subject to the introduction of dirt or other foreign particles between electrical contacting surfaces. Since it is in continuous contact, the present invention avoids loss of contact or introduction of electrical noise which could result from discontinuities in the surface of the rotary member with which it is in contact.

Although the invention has been shown and described with respect to a preferred embodiment thereof, it should be understood by those skilled in the art that various changes, omissions and additions in the form and detail thereof may be made thereto without departing from the spirit and the scope of the invention.

Having thus described a typical embodiment of my invention, that which I claim as new and desire to secure by Letters Patent of the United States is:

1. A rotary electrical connection comprising:

an annular frame member;

a plurality of circular segment, self-lubricating, electrically conductive brush members loosely restrained within said annular frame member to provide substantially a full circle of electrical contact surface;

means resiliently urging said brush members into contact with said frame member;

means resiliently urging said brush members radially inward, thereby to ensure contact with a rotating member when disposed within said frame member; and means providing for connection of an electrical conductor to said frame member.

2. The new use of a structure consisting of an annular frame member, a plurality of circular segment, self-lubricating, electrically conductive brush members loosely restrained within said annular frame member, means resiliently urging said brush members into contact with said frame member, and means resiliently urging said brush members radially inward, thereby to ensure contact with a rotating member when disposed within said frame member, which comprises:

providing an electrical contact to said frame member; and using said structure as a rotary electrical connector between an electrical conductor connected to said contact and a rotating body of circular cross section disposed within said structure in contact with said brush elements.

* * * * *